US006189430B1

(12) United States Patent
Vornfett

(10) Patent No.: US 6,189,430 B1
(45) Date of Patent: Feb. 20, 2001

(54) WEAPON SYSTEM

(75) Inventor: Karl Ulrich Vornfett, Unterluess (DE)

(73) Assignee: TZN Forschungs-und Entwicklungszentrum

( * ) Notice: Under 35 U.S.C. 154(b), the term of this patent shall be extended for 0 days.

(21) Appl. No.: 09/337,128

(22) Filed: Jun. 21, 1999

(30) Foreign Application Priority Data

Jun. 19, 1998 (DE) ..... 198 27 378

(51) Int. Cl.[7] ..... B64D 1/04
(52) U.S. Cl. ..... 89/6.5; 102/211
(58) Field of Search ..... 89/6, 6.5, 1.55, 89/1.6; 102/206, 211

(56) References Cited

U.S. PATENT DOCUMENTS 4,774,418 9/1988 Kjersem .
5,473,986 * 12/1995 Hau ..... 102/206
6,085,629 * 7/2000 Thiesen et al. ..... 89/6.5

FOREIGN PATENT DOCUMENTS 2 059 665 * 6/1972 (DE) .
3443150 * 3/1987 (DE) ..... 89/6
38 30 903 A1 * 3/1990 (DE) .
4137819A1 5/1993 (DE) .
0798 535 A1 10/1997 (EP) .

* cited by examiner

*Primary Examiner*—Stephen M. Johnson
(74) *Attorney, Agent, or Firm*—Venable; Norman N. Kunitz

(57) ABSTRACT

A weapon system, comprising a fire control system (1) and an ammunition unit (3) that can be fired from a weapon and that has at least one electronic switching device (8) that can be actuated by the fire control system (1). To achieve a constant, secure and simple monitoring of the link between the fire control computer (1) and the electronic switching device (8) to be triggered of the respective ammunition unit (3), a bidirectional data transfer is conducted via the two supply lines (15, 16) that are necessary for the voltage and current supply of the electronic switching device (8) of the respective ammunition unit (3). In the process, data are transmitted from the fire control system (1) to the electronic switching device (8) by a voltage modulation of the supply voltage, and data are transmitted from the switching device (8) to the fire control system (1) by a current modulation of the operating current.

4 Claims, 2 Drawing Sheets

WEAPON SYSTEM

REFERENCE TO RELATED APPLICATIONS

This application claims the priority of German Patent Application No. DE 19827378, filed Jun. 19, 1998, which is incorporated herein by reference.

BACKGROUND OF THE INVENTION

The invention relates to a weapon system, having a fire control system and an ammunition unit that can be fired from a weapon of the weapons systems.

For the ammunition identification in such weapon systems, it is known to store ammunition-specific data such as type of ammunition, batch number, date of manufacture, etc. directly in a data memory inside the ammunition (e.g., German published Patent Application No. DE 41 37 819 A1). Following the loading of the respective cartridge into the weapon chamber, these data are read automatically by means of a reading device and are transferred to the fire control system. By taking into account these data, as well as target-specific data, the fire control system subsequently generates directional signals for the aiming device of the weapon and, if necessary, control signals for activating an electronically programmable fuze, installed in the respective cartridge. For this purpose, the fuze has an electronic switching device with a microcontroller, arranged inside the cartridge.

The control signals for known weapon systems are transmitted from the fire control computer to the electronic switching device assigned to the cartridge fuze, either through inductive feeding or through voltage modulation of the supply voltage for the component. In both cases, there is no feedback to the fire control computer to indicate the actual (correct) transmitting of data.

It is the object of the present invention to provide a weapon system that allows a constant, secure monitoring in a simple manner of the link between the fire control computer and the structural components that can be triggered in the respective ammunition unit.

SUMMARY OF THE INVENTION

The above object generally is achieved according to the present invention by a weapon system, comprising a fire control system and an ammunition unit that can be fired from a weapon of the weapon system: and wherein: the ammunition unit includes at least one electronic switching device that can be triggered by control signals provided by the fire control system and that contains a microcontroller, with the switching device being connected to an external current/voltage supply unit; a converter is connected between the ammunition unit and the fire control system for, in response to control signals from the fire control system, modulating the supply voltage provided by the supply unit for the electronic switching device with signals corresponding to the control signals from the fire control system, and which corresponding signals can be demodulated by the electronic switching device; the electronic switching device includes a circuit arrangement which, in response to detected control signals from the fire control system, transmits data signals to the fire control system by modulating the supply current for the switching device; and, the converter includes a circuit that detects and demodulates the modulation on the supply current and provides further data signals corresponding thereto to the fire control system.

Further advantageous embodiments of the invention are disclosed and discussed.

Essentially, the invention is based on the idea of having a bidirectional data transmission over the two lines needed for the voltage supply and the current supply of the electronic switching device for the respective ammunition unit. In the process, data are transmitted from the fire control system to the electronic switching device by means a voltage modulation of the supply voltage, and data are transmitted from the switching device to the fire control computer by a current modulation of the operating current.

Such a bidirectional data transmission furthermore permits the continuous monitoring of the operating current and the transmission voltage for a secure detection of interruptions or short circuits in the connecting lines. This is particularly advantageous since the contacting of the ammunition occurs via a mechanical contacting, which can be hindered by vibrations and other interfering factors.

A converter, connected in series between the fire control system and the ammunition unit, is provided for modulating the supply voltage as well as demodulating the operating current. The modulated supply voltage is demodulated inside the ammunition unit and the operating current is then modulated with the aid of interface components and the microcontroller in the electronic switching device.

In that case, the converter and the electronic switching device of the respective ammunition unit operate based on the master-slave principle, wherein the converter assumes the master function.

Further details and advantages of the invention can be understood from the following exemplary embodiments explained with the aid of the figures.

DETAILED DESCRIPTION OF THE PREFERRED EMBODIMENT

Figure 1:
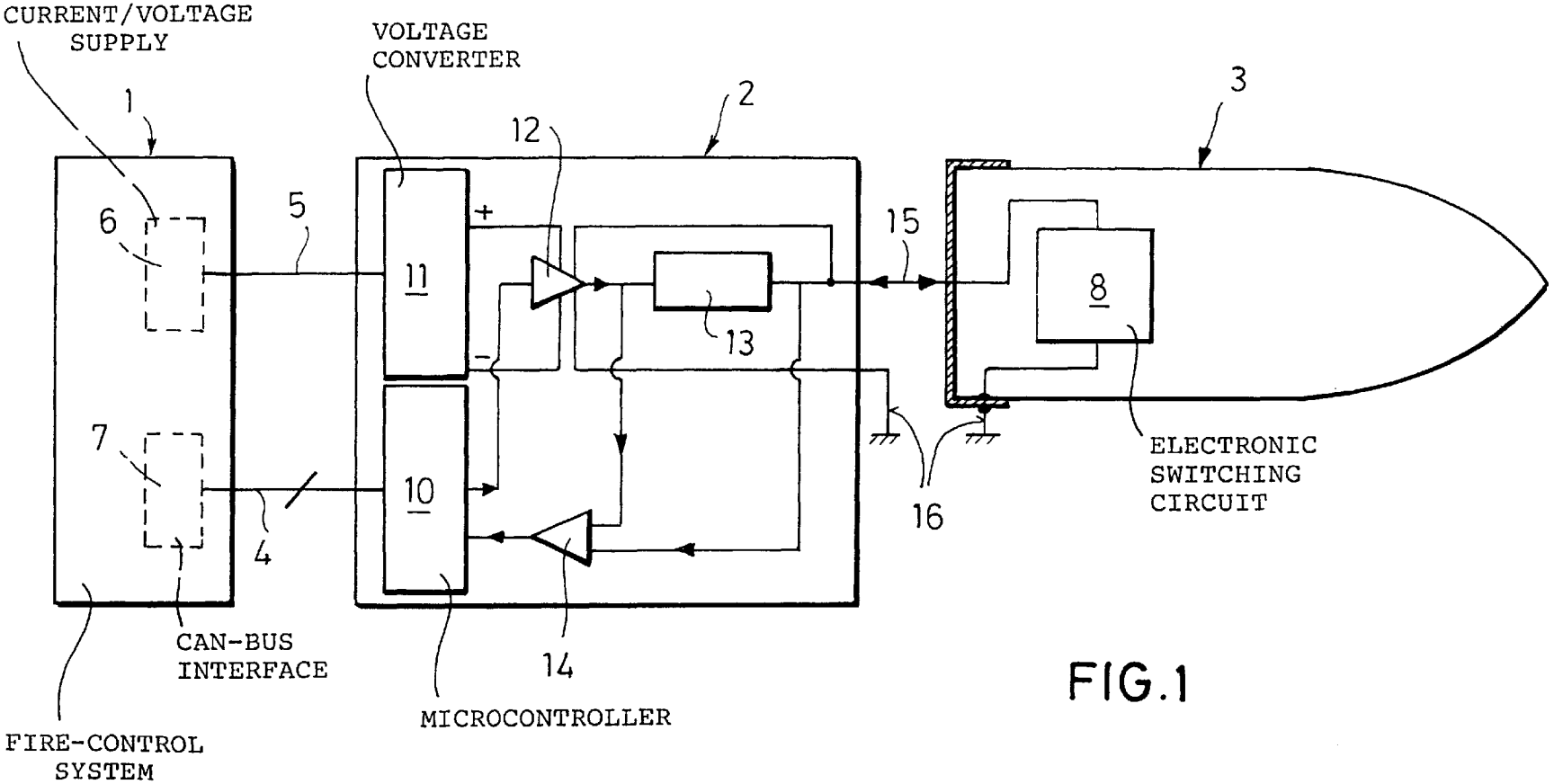
FIG. 1 is a schematic representation of a weapon system according to the invention, comprising a fire control computer, a converter, and an ammunition unit with electronic switching device.

In FIG. 1, the number 1 represents a fire control system, e.g. for a battle tank, the number 2 represents a converter and the number 3 represents a cartridge inside the non-depicted weapon tube for the tank. The fire control system 1 is connected to the converter 2 via a bidirectional CAN data bus 4, ISO-IS 11898 e.g., according to International Organization for Standardization International Standards, as well as, for example, via a two-lead cable 5 for the current supply and the voltage supply for the converter 2, and the cartridge 3. In that case, the current/voltage supply unit that is integrated into the fire control system 1 is given the reference number 6 and the CAN-bus interface is given the reference number 7.

Figure 2:
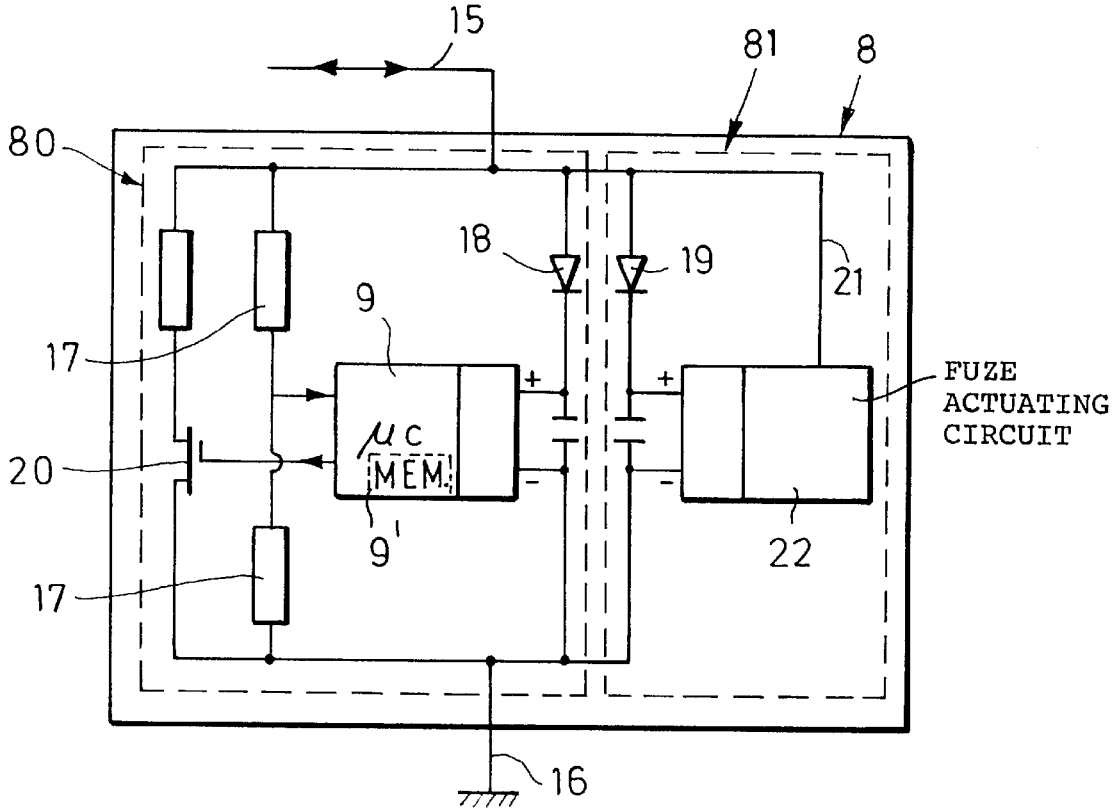
FIG. 2 is a block circuit diagram of the electronic switching device with the reference number 8 in FIG. 1.

The cartridge 3 contains an electronic switching device or circuit 8, comprising two components 80 and 81 (See FIG. 2), which switching device 8 can be actuated by the fire control system 1. The first component 80 contains a microcontroller 9 with a data memory for storing ammunition-specific data, e.g. firing table parameters. The second electronic component 81 serves to activate the fuze, that is not shown here for reasons of clarity, for the projectile or cartridge 3.

The converter 2, arranged between the cartridge 3 and the fire control system 1, functions to supply the switching device 8 with voltage as well as to modulate the supply voltage with the control signals transmitted by the fire control system 1. In that case, the control signals contain, for example, also the request for the firing table parameters from the memory 9' of the component 80, and the input of fuze setting data for the component 81 inside the cartridge 3.

For the voltage supply of switching device 8, an output voltage of, for example, 30 V is generated in the converter 2 with the aid of a voltage converter 11 and a downstream-connected power amplifier 12. The output voltage is constant and independent of the current consumption of the switching device 8 if no data transfer occurs in the ammunition.

For the voltage modulation, a microcontroller 10 that is arranged in the converter 2 converts the signal level and the protocol of the CAN-bus interface 7 into signal levels and protocols of an RS232 interface. The high levels and low levels of the RS232 interface are converted to a ±ÿ5V voltage and are modulated upon the supply voltage in the power amplifier 12.

In order to transmit fuze setting data to the component 81, the CAN-bus data is converted in the microcontroller 10 into time-dependent voltage pulses with negative voltage (e.g. −10V). For this, the supply voltage is briefly switched from approximately +30V to −10V with the aid of the controlled power amplifier 12. The time interval for the start-stop pulse in this case is proportional to the ignition time to be transmitted.

During the total transmission time, the flow of current is monitored continuously with a precision measuring resistor 13 with a downstream-connected current amplifier 14 having inputs connected across the precision resistor 13. With this arrangement, not only can the modulation of operating current be detected, but moreover, line breaks that are caused, for example, by the galvanic contacting of the ammunition or by short circuits in the line, can be detected.

The modulated supply voltage is subsequently supplied via the supply lines 15 and 16 to the components 80, 81 of the electronic switching device 8 and is modulated by these components. In the component 80, the modulated supply voltage (e.g., of 30V±5V) is compared, with the aid of a voltage divider 17, to a reference voltage and is again converted to a high/low level in order to feed it as an RS232 signal to the microcontroller 10.

The component 81 reacts only to time-controlled negative voltage pulses (−10V) via its signal input 21 connected to a circuit 22 for actuating a fuze of the projectile of the ammunition unit 3, and is not influenced by the transmission of data into the component 80. The component 80 on the other hand recognizes with the aid of a voltage window comparator that the voltage modulation in the negative range contains only data for the component 81.

With the aid of diodes 18 and 19, as well as additional components, it is ensured that a modulation of the supply voltage does not effect the operational readiness of the components 80 and 81.

The demodulated signal values are used for triggering the components 80 and 81. Thus, the microcontroller 9 of component 80 is prompted, for example, to transmit the firing table parameters stored in its memory 9' to the converter 2. In the process, the requested signal values from the memory of the microcontroller 9 are transmitted with the aid of a current modulation of the operating current to the converter 2. For this, the transistor-transistor logic (TTL) signals of the microcontroller 9 trigger a controlled variable load resistor 20, shown here as a field effect transistor, so that a high signal, for example, causes an increase in the operating current and a low signal causes a reduction in the operating current of the component 80.

The operating current modulated in this way is subsequently demodulated in the converter 2. In that case, the operating current for component 80 is demodulated by the measuring resistor 13 and the power amplifier 14, regardless of the supply voltage value. The positive-negative change in the operating current, caused by the data modulation in the component 80, results in a proportional voltage at the measuring resistor 13 of converter 2, which is changed to corresponding (TTL) signals with a voltage comparator in the microcontroller 10. These signals are detected because of the RS232 data protocols used. In the controller 10, they are converted to the CAN-bus data protocol for a more rapid data transfer via line 4 to the CAN-bus interface 7 in the fire control computer 1.

In contrast to the component 80, the component 81 (FIG. 2) does not contain a microcontroller. The fuze setting time is transmitted via a negative start-stop voltage pulse. The time between start pulse and stop pulse is an analog measure and is proportional to the time to be adjusted for setting the fuze. A bidirectional data communication with the component 81 occurs only on a limited scale. If the setting of the fuze is done correctly, it is acknowledged by a brief increase in the operating current. The decoding in this case also occurs inside the converter 2 through the current detection with the aid of the measuring resistor land the shunt connected amplifier 14.

The invention now being fully described, it will be apparent to one skilled in the art that many changes and modifications can be made thereto without departing from the spirit or scope of the invention as set forth herein.

What is claimed:

1. A weapon system, comprising a fire control system and an ammunition unit that can be fired from a weapon of the weapon system: and wherein:

the ammunition unit includes at least one electronic switching device that can be triggered by control signals provided by the fire control system and that contains a microcontroller, with said switching device being connected to an external current/voltage supply unit;

a converter is connected between the ammunition unit and the fire control system for, in response to control signals from the fire control system, modulating the supply voltage provided by the supply unit for the electronic switching device with the control signals from the fire control system, and which signals can be demodulated by the electronic switching device;

the electronic switching device includes a circuit arrangement which, in response to detected control signals from the fire control system, transmits data signals to the fire control system by modulating the supply current for the switching device; and, the converter includes a circuit that detects and demodulates the modulation on the supply current and provides further data signals corresponding thereto to the fire control system.

2. A weapon system according to claim 1, wherein the electronic switching device includes a data memory for storing ammunition-specific data, which are subjected to a data pre-processing by the microcontroller before being transmitted to the fire control system.

3. A weapon system according to claim 1, wherein the electronic switching device includes an electronic component for activating a projectile fuze of the ammunition unit.

4. A weapon system according to claim 1, wherein the ammunition unit includes two electronic components that can be triggered by said control signals from the fire control system, with the first component containing the microcontroller which contains a bidirectional interface and a data memory for storing ammunition-specific data, and the second component containing an electronic switching device for activating a projectile fuze of the ammunition unit.

* * * * *